US005893674A

United States Patent [19]

Dowst

[11] Patent Number: 5,893,674

[45] Date of Patent: Apr. 13, 1999

[54] WRITING INSTRUMENT

[75] Inventor: William P. Dowst, Reading, Mass.

[73] Assignee: The Gillette Company, Boston, Mass.

[21] Appl. No.: 08/937,400

[22] Filed: Sep. 25, 1997

[51] Int. Cl.[6] ..... B43K 7/00

[52] U.S. Cl. ..... 401/209; 401/6; 401/207; 401/214; 401/216

[58] Field of Search ..... 401/6, 209, 216, 401/207, 214

[56] References Cited

U.S. PATENT DOCUMENTS

| | | | |
|---|---|---|---|
| D. 299,660 | 1/1989 | Gordo | D19/54 |
| D. 302,442 | 7/1989 | Gordo | D19/55 |
| 3,281,933 | 11/1966 | Fehling et al. | 29/520 |
| 3,352,621 | 11/1967 | Fehling et al. | 401/109 |
| 3,396,569 | 8/1968 | Miller | 72/369 |
| 3,945,735 | 3/1976 | Nakashiki et al. | 401/216 |
| 3,972,630 | 8/1976 | Schenk | 401/217 |
| 4,594,015 | 6/1986 | Pomares | 401/207 |
| 5,012,663 | 5/1991 | Brown | 72/369 |
| 5,172,994 | 12/1992 | Brown | 401/209 |
| 5,527,124 | 6/1996 | Kolaric | 401/6 |

FOREIGN PATENT DOCUMENTS

| | | | |
|---|---|---|---|
| 1032122 | 6/1953 | France . | |
| 2151240 | 4/1973 | France . | |
| 801614 | 1/1951 | Germany | 401/216 |
| 871258 | 3/1953 | Germany . | |
| 879811 | 6/1953 | Germany . | |
| 902352 | 1/1954 | Germany . | |
| 496361 | 9/1952 | Italy | 401/216 |
| 776706 | 1/1979 | Russian Federation . | |
| WO 98/13216 | 4/1998 | WIPO . | |

OTHER PUBLICATIONS

Translation of the German patent No. 801,614, Jan. 15, 1951.

*Primary Examiner*—Robert M. Fetsuga
*Assistant Examiner*—Tuan N. Nguyen
*Attorney, Agent, or Firm*—Donal B. Tobin; Chester Cekala; Aubrey C. Brine

[57] ABSTRACT

A writing instrument having an elongated barrel comprised of an outer portion and an inner portion, rotatable relative one to the other. The point or writing tip is fixed to the barrel inner portion, disposed at an angle to, and may be offset from, the centerline of the barrel outer portion. The barrel inner portion is caused to rotate relative to the barrel outer portion by pressure on the writing instrument or weights attached to the barrel inner portion to bring the point into desired alignment during the writing process.

15 Claims, 3 Drawing Sheets

WRITING INSTRUMENT

BACKGROUND OF THE INVENTION

The present invention relates to an instrument having a working point which is applied to a surface, and more particularly to a manually-manipulated instrument wherein the working point is offset axially from the centerline of the instrument body.

Various instruments having a point which is applied to a surface are available on the market. These instruments include, but are not limited to, writing systems, such as fountain pens, ballpoint pens, as well as correction fluid applicators and the like. The writing instruments, as a general rule, comprise a writing tip or point which extends from the barrel containing the ink supply, the instrument being held in the hand of the user during the writing process. In most of these writing instruments, particularly ballpoint pens, the writing tips are known to function more effectively if retained in a perpendicular position relative to the surface being written on. However, in most instances the writing instrument is not applied vertically during the writing process, but is inclined to the writing surface by the user at an angle which is generally in the vicinity of 60° to the writing surface.

In the case of a ballpoint pen, typically applied to the writing surface at about a 60° angle, the rim surrounding the ball may contact the writing surface and interfere with the smooth operation of the ball. A danger also exists that application at a 60° angle may provide wear to the ball to the extent that the ball becomes loosened.

In view of the above, it has been proposed that the point or ball-carrying portion of the ballpoint pen be oriented such that it extends at an angle to the axis of the writing instrument barrel to compensate for the tilting of the barrel during the writing process. A pen which is typical of this type of instrument is shown and described in U.S. Pat. No. 5,012,663, issued to Robert L. Brown and assigned to the assignee of the present invention.

It has, however, been found that in employing a pen of the type described above, wherein the point is disposed at an angle with the barrel longitudinal axis, orientation of the point is often difficult and may result in a poor quality of writing being produced. If the point is not oriented such that it lies at right angles to the writing surface, the user will have to re-orient the writing instrument or writing will proceed on the rim of the point.

It is, therefore, an object of the present invention to provide a writing instrument wherein the point extends at an angle to the longitudinal axis of the barrel wherein proper orientation of the point to the writing surface is ensured.

Another object of the invention is to provide a writing instrument of the type set forth above which provides proper orientation of the point to the writing surface prior to the start of the writing process.

Yet another object of the invention is to provide a writing instrument of the type set forth above which is simple in construction and easily manufactured.

SUMMARY OF THE INVENTION

The aforementioned objects and other objectives which will become apparent as the description proceeds are accomplished by providing a manually-manipulated instrument comprising an elongated tubular barrel member having a longitudinal axis. A working point for application to a surface is at one end of the barrel and the point is mounted for rotation about the barrel longitudinal axis.

In an more detailed sense, the instrument may be a writing instrument having an elongated tubular barrel member with a longitudinal axis and a writing point mounted on one end of the barrel. The point may be disposed at an angle with respect to the barrel longitudinal axis and mounted for rotation about the longitudinal axis. The writing instrument may be in the form of a ballpoint pen, in which instance the point comprises a writing ball.

The longitudinal axis is generally disposed at the centerline of the elongated tubular barrel and the instrument may further include an elongated member mounted for rotation in the elongated tubular barrel, in which case the point is fixed to the elongated member for rotation with the member.

Both the tubular barrel and the elongated member are preferably cylindrical in shape and the elongated member may comprise an ink cartridge when the writing instrument is a pen.

In one embodiment of the writing instrument the elongated member comprises a weight portion disposed on the elongated member on the opposite side of the longitudinal axis from that of the point.

BRIEF DESCRIPTION OF THE DRAWING

Reference is made to the accompanying drawing in which there are shown illustrative embodiments of the invention from which its novel features and advantages will be apparent, wherein.

DESCRIPTION OF THE PREFERRED EMBODIMENT

Figure 2:
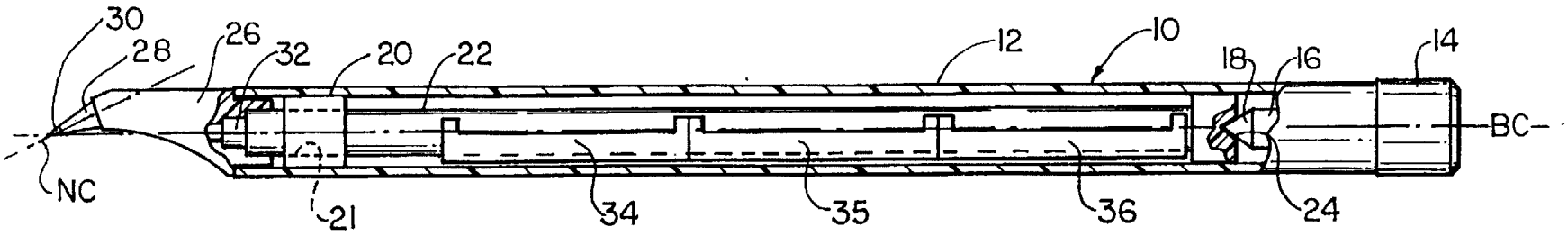
FIG. 2 is a side elevational view, similar to FIG. 1, showing an alternate embodiment of the structure of FIG. 1.
Figure 1:
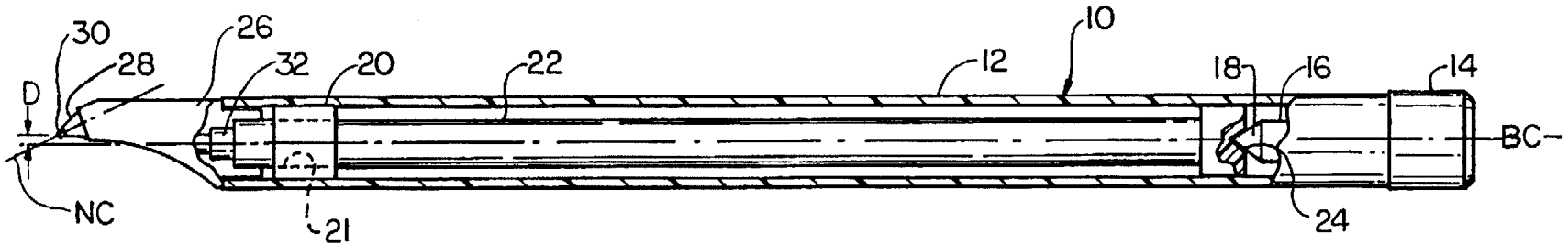
FIG. 1 is a side elevational view, partially in section, showing a ballpoint pen constructed in accordance with the teachings of the present invention.

Referring to the drawing, and in particular to FIGS. 1 and 2, there is shown a writing instrument in the form of a ballpoint pen 10 comprising an outer member or barrel 12 which is cylindrical in form, having a longitudinal axis BC. The barrel 12 is open at the forward end and has a cap 14 provided at the rearward most end to enclose that end of the cylindrical body. A cylindrical bearing member 16 having a conical bearing surface 18 is mounted on the inner surface of the cap 14 and extends along the longitudinal axis BC, on which the tip of the conical surface 18 is located. A cylindrical bearing 20 having an inner bearing surface 21 is fixed to the inner portion of the barrel 12 adjacent the forward end of the barrel.

An elongated cylindrical member 22 is mounted for rotation within the barrel 12 providing a sliding fit within the bearing surface 21 and having a conical recess 24 formed in the rearward surface thereof for mating engagement with the bearing surface 18 adjacent the rear of the barrel 12. At the forward end of the elongated cylindrical member 22 there is mounted a writing tip 26 the tip being fixed to the outer surface of the cylindrical member, but in spaced relation to the inner surface of the barrel 12 such that the tip is free to rotate with the cylindrical member 22, within the barrel 12. A writing element in the form of a cone-shaped point 28 is mounted at the forward end of the writing tip 26, the cone-shaped writing element having a centerline NC disposed at an angle to the longitudinal axis BC of the barrel 12. In the present embodiment, that of a ballpoint pen, a ball 30 which may be of any type well known in the art is provided at the forward end of the point 28, the ball being disposed on the centerline NC and spaced a distance D from the longitudinal axis BC.

An ink supply for the ball 30 is provided by an ink cartridge 32 which may be a replaceable element received in the elongated cylindrical member, or in the instance of a disposable pen, may be integral with the cylindrical member 22.

Preferably, in the construction shown in FIG. 1 the distance D between the ball 30 and the longitudinal axis BC is between 0.01 inch and 0.10 inch, while the angle between the centerline NC of the point 28 is generally in the area of 30°, but may be between 20° and 40°.

Figure 3:
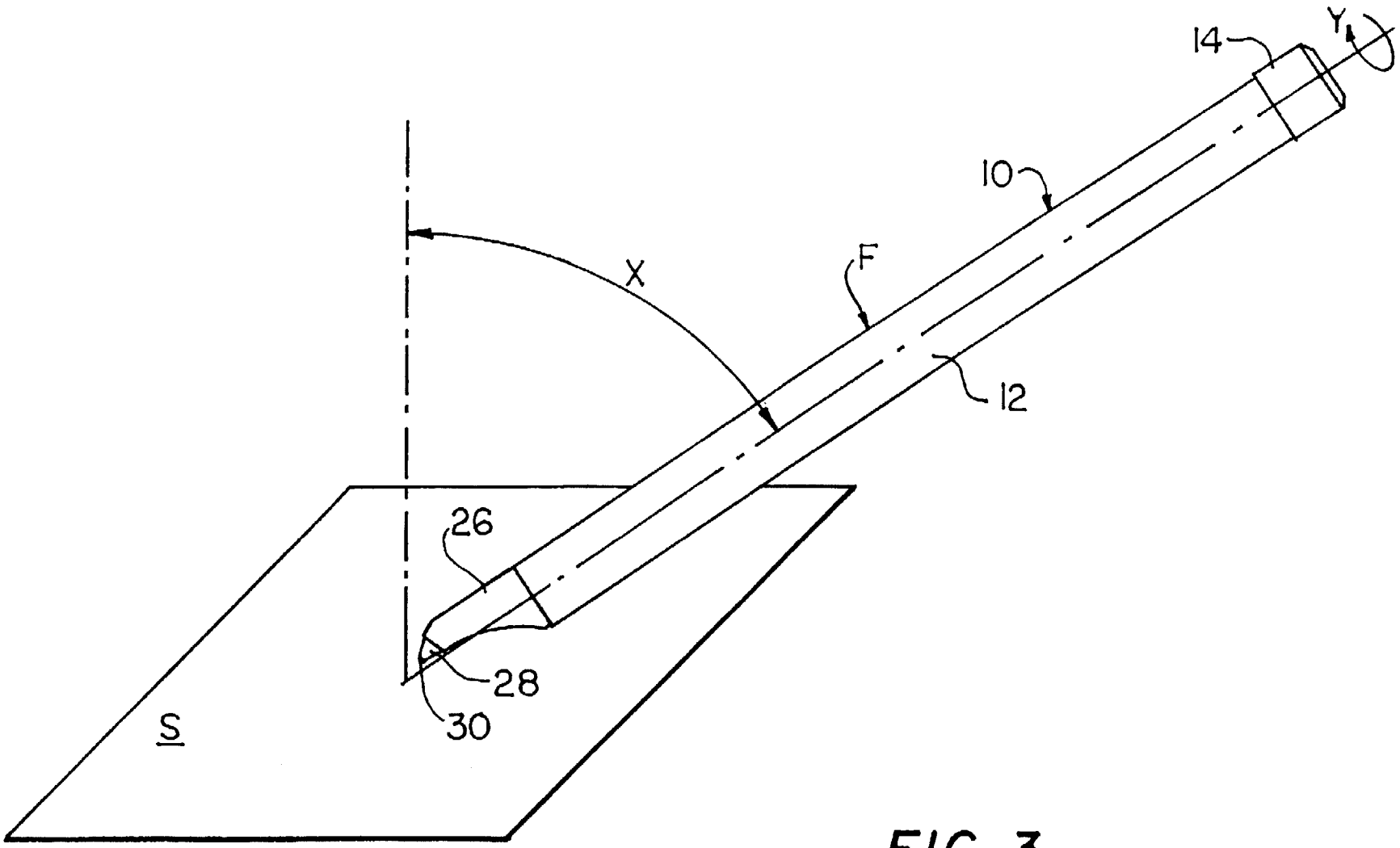
FIG. 3 is a diagrammatic view showing the ballpoint pen of FIGS. 1 or 2 during the writing process.
Figure 4:
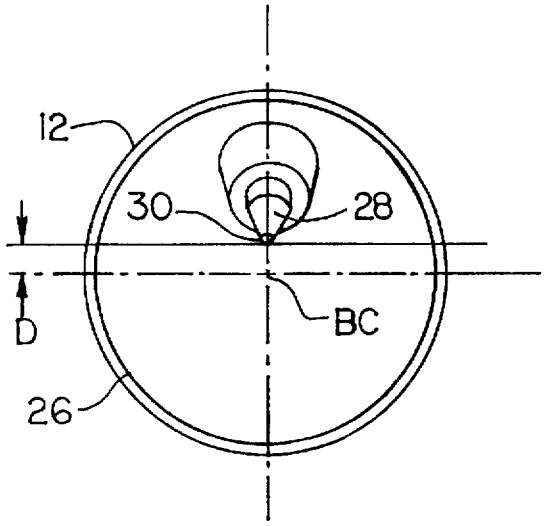
FIGS. 4 and 5 are schematic representations of the ballpoint pen of FIG. 3 as viewed from the point end of the pen.
Figure 5:
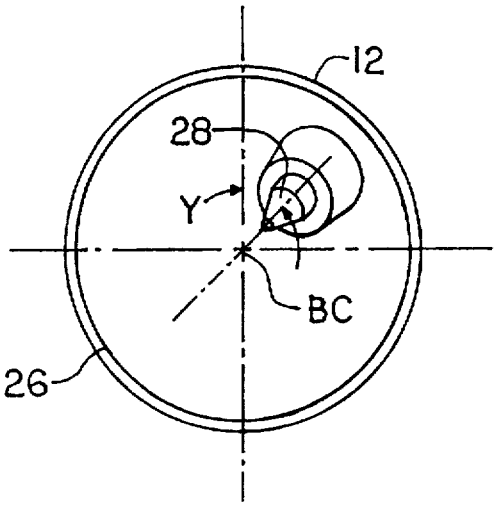

Referring now to FIGS. 3, 4 and 5, the ballpoint pen 10 of FIG. 1 is depicted in positions assumed during the writing process. As shown in FIG. 3, the ballpoint pen 10 is positioned by the user relative to a writing surface S at an angle X from the perpendicular, as the ball 30 contacts the writing surface. At the moment of contact with the writing surface, or just prior thereto, the elongated cylindrical member 22 may be at a position wherein the point 28 is not in its neutral position (that is, the position wherein the centerline NC of the conical point is at right angles to the surface S), but is offset at an angle Y. When a perpendicular writing force F is applied to the barrel 12 of the ballpoint pen 10, a restoring torque T is applied at the point 28 counter rotating the elongated cylindrical member 22 in the direction that of the angle Y, and the centerline NC of the point 28 is directed at the proper angle to the writing surface S.

As a formula, the restoring torque T is equal to D which is the distance of the ball 30 from the longitudinal axis BC of the barrel 12, times the perpendicular force F times the sine of angle X times the sine of angle Y; or $$T=D\cdot F\cdot \text{SINE } X\cdot \text{SINE } Y.$$

As shown in FIGS. 4 and 5, should the point 28 contact the surface S as shown in FIG. 5, the writing process will cause the force F to be applied to the barrel 12 and the elongated cylindrical member will rotate to move the point 28 and ball 30 to the "neutral position," as shown in FIG. 4.

In FIG. 2, an alternate embodiment of the invention is shown wherein all elements as described above are indicated by like reference numerals to those of the embodiment shown in FIG. 1. However, in the embodiment of FIG. 2 a plurality of weights 34, 35 and 36 are affixed to the outer surface of the cylindrical member 22. The weights 34, 25 and 36 are disposed on the surface of the cylindrical member 22 and positioned 180° from the ball 30 about the longitudinal axis BC. In the structure of the FIG. 2, the weights 34, 35 and 36 retain the ball 30 above the longitudinal axis BC when the longitudinal axis is horizontally disposed, or at an acute angle to the writing surface.

It should be understood that with the construction shown in FIG. 2 the provision for properly locating the ball 30 on the surface S is substantially provided by employing the weights 34, 35, and 36. Therefore, with the construction shown in FIG. 2 the force F will serve to cause rotation of the point 28 and ball 30 into the proper alignment for providing the optimum in quality writing. It will be noted that with the providing of the weights 34, 35 and 36 as a rotational means, it is not necessary to produce the restoring torque provided by the distance D in the structure of FIG. 1, as explained above. The ball 30, therefore, may be located on the longitudinal centerline BC, or at another location, as desired.

While the "restoring torque" described above is a major factor in the proper orientation of the point 28 to the writing surface in the structure of FIG. 1, it should be understood that a variety of torque forces may be present on a particular writing instrument. These torques may include, but are not limited to, wobble torque (impact by change of direction during writing), dampening torque (impact by bearing friction), and, as in the structure of FIG. 2, torque imparted by weights.

It should further be understood that while the instrument described herein is a pen of the ballpoint type, the present invention is equally applicable to other instruments having a working point applied to a surface such as metal roller pens, gel ink pens, fountain pens, or applicators for correction fluid or the like.

While it is apparent that changes and modifications can be made within the spirit and scope of the present invention, it is my intention, however, only to be limited by the appended claims.

As my invention I claim:

1. A writing instrument comprising:

an elongated barrel member having a longitudinal axis and a rear end having a bearing surface; wherein said elongated barrel is tubular and further includes an elongated member having a forward end and a rearward end which defines a rearward surface thereof engaging the bearing surface;

a writing point mounted on a forward end of said barrel; and said point being disposed at an angle with respect to said barrel longitudinal axis and is fixed to said forward end of said elongated member for rotation with said elongated member about said barrel longitudinal axis during usage of the writing instrument.

2. A writing instrument as set forth in claim 1 wherein said writing instrument is a ballpoint pen and said point comprises a writing tip.

3. A writing instrument as set forth in claim 2 wherein said writing tip is offset from said longitudinal axis.

4. A writing instrument as set forth in claim 2 wherein said longitudinal axis is disposed at the centerline of said elongated barrel member.

5. A writing instrument as set forth in claim 1 wherein said longitudinal axis is disposed at the centerline of said elongated barrel.

6. A writing instrument as set forth in claim 1 wherein said tubular barrel and said elongated member are cylindrical in shape.

7. A writing instrument as set forth in claim 1 wherein said elongated member comprises an ink cartridge.

8. A writing instrument as set forth in claim 1 which further includes means for rotating said elongated member within said tubular barrel.

9. A writing instrument as set forth in claim 7 wherein said means for rotating said elongated member within said tubular barrel comprises a weighted portion of said elongated member disposed on the opposite side of said longitudinal axis from that of said writing point.

10. A writing instrument as set forth in claim 4 wherein said tubular barrel and said elongated member are cylindrical in shape.

11. A writing instrument as set forth in claim 10 wherein said elongated member comprises an ink cartridge.

12. A writing instrument as set forth in claim 11 wherein said elongated member comprises a weighted portion thereof disposed on said elongated member on the opposite side of said longitudinal axis from that of said writing point.

13. A writing instrument as set forth in claim 12 wherein said writing ball is offset from said longitudinal axis.

14. A manually-manipulated instrument comprising:

an elongated barrel member having a longitudinal axis and a rear end having a bearing surface, wherein said enlongated barrel is tubular and further includes an elongated member having a forward end and a rearward end which defines a rearward surface thereof engaging the bearing surface adjacent a rear end of said barrel, a working point for application to a surface disposed at a front end of said barrel, and said point being disposed at an angle with respect to said barrel longitudinal axis and is fixed to said forward end of said elongated member for rotation with said elongated member about said barrel longitudinal axis during usage of the instrument.

15. The instrument of claim 14 wherein said working point is a writing tip.

* * * * *